United States Patent [19]

Wilson et al.

[11] 3,982,589

[45] Sept. 28, 1976

[54] CLEANING AND PUMPING APPARATUS FOR OIL WELL PRODUCTION

[75] Inventors: Phillip M. Wilson, Downey; John W. Erickson, Huntington Beach; Charles C. Nelson, Long Beach; Vitolis Budrys, La Mirada, all of Calif.

[73] Assignee: Kobe, Inc., Huntington Park, Calif.

[22] Filed: May 16, 1975

[21] Appl. No.: 578,358

[52] U.S. Cl. ..... 166/53; 166/75 R

[51] Int. Cl.[2] ..... E21B 43/00

[58] Field of Search ..... 166/53, 75, 105.5, 105.6; 233/47 R, 29; 417/77, 79–83

[56] References Cited

UNITED STATES PATENTS

| | | | |
|---|---|---|---|
| 3,709,292 | 1/1973 | Palmour | 166/105.5 |
| 3,759,324 | 9/1973 | Mecusker | 166/75 |
| 3,782,463 | 1/1974 | Palmour | 166/105.5 |
| 3,802,501 | 4/1974 | Mecusker | 166/75 |
| 3,817,446 | 6/1974 | Erickson | 233/47 R |

*Primary Examiner*—James A. Leppink
*Attorney, Agent, or Firm*—Christie, Parker & Hale

[57] ABSTRACT

A system is provided for pumping high pressure power liquid for a downhole hydraulic pump for producing fluids from an oil well. The power liquid is mixed in the well with the produced well fluid and is conveyed to a phase separation vessel at the surface where gas, oil and water are gravity separated. Power liquid is withdrawn from this vessel to the inlet of a combined pitot pump and centrifugal cleaner. This combined pump and cleaner has a stationary housing and a rotatable cleaning chamber. A stationary pitot tube in the rotatable housing provides pressurized clean power liquid for the suction inlet of a high pressure multiplex piston pump that feeds power liquid to the downhole pump. The rotating chamber has passages at its periphery for discharging dirty liquid which drains from the housing and is pumped to a production flow line. Fluids from the phase separation vessel are also recovered through the production flow line.

Also, means are provided for interrupting pumping in case of excessive or deficient flow of dirty liquid from the cleaner. Preferably the dirty liquid is pumped to the production flow line by a jet pump powered either by pressurized power liquid from the pitot tube outlet in a high pressure embodiment or by power liquid from the high pressure piston pump in a lower pressure embodiment.

15 Claims, 3 Drawing Figures

CLEANING AND PUMPING APPARATUS FOR OIL WELL PRODUCTION

BACKGROUND

Artificial lift is used in many oil wells for raising oil and water to the surface. One technique which is involved in practice of this invention employs a high pressure multiplex piston pump at the ground surface to provide hydraulic pressure in tubing running down the well. The high pressure power liquid (or power fluid, as it is often called) from the high pressure pump operates a downhole pump for raising the produced fluids to the surface. A variety of such downhole pumps are commercially available and many of them mix the spent power liquid with the produced fluids in the well.

When the mixture of produced fluid and power liquid reaches the ground surface, it is typically separated into water, oil and gas phases by gravity separation. Water or oil from this separation is used as the power liquid.

In large installations where there are a number of wells, the power liquid may be withdrawn from a tank in the storage battery, and cleaned to be suitable for use in the downhole pump. Chemical additives for corrosion inhibition and enhanced lubricity may also be used. Such central stations for power liquid are relatively expensive when the well heads are scattered since appreciable high pressure piping may be required. In many situations it is therefore desirable to provide individual power fluid units for each well. Typically, these are skid mounted units having a separator vessel and high pressure pump to supply high pressure power fluid to a well head and receive and separate the commingled power fluid and production fluid. Such a unit for a single well includes its own prime mover, such as an electric motor or internal combustion engine to drive the pump.

Since the power liquid and production fluid are commingled in the well, particles of solids may become suspended in the power liquid. The efficiency of a downhole pump, particularly a reciprocating piston type, depends at least in part on minimized leakage of power liquid around the piston. To minimize such leakage precision parts are employed with extremely close tolerances between mating surfaces. Very small abrasive particles contained in the power liquid can, therefore, cause damaging wear on the pump parts, requiring replacement and repair of the downhole pump. Unless the power liquid is well cleaned a downhole pump may fail to perform adequately after only a few months of service. It is, therefore, highly desirable to remove particles of abrasive materials from the power liquid down to very small sizes.

Such cleaning can be accomplished in a central station serving several wells but becomes more of a problem in the isolated single well pumping units that are preferred for many oil field operations.

One technique that has been used for cleaning power liquid employs a cyclone centrifugal separator where liquid is introduced tangentially into a conical housing. Relatively dirty liquid containing particulate solids more dense than the liquid is discharged from the small end of the cone. Relatively clean liquid is discharged through the center of the larger end of the cone. Such a single well system is described in U.S. Pat. No. 3,709,292 by Palmour. A cleaning apparatus for power liquid employing cyclone centrifugal separators is also described in U.S. Pat. No. 3,802,501 to Mecusker. A single well unit employing a cyclone centrifugal cleaner has also been available from Kobe, Inc., assignee of this application. Such a unit is described in Bulletin SU-374 from Kobe, Inc. A copy of this bulletin and the aforementioned patents accompany this application.

Cyclone centrifugal separators are sensitive to the underflow flow rate, that is, the proportion of dirty liquid withdrawn from the smaller end of the cyclone. The flow rate needs to be carefully controlled and in a single well power fluid unit, there must be a careful balance of three operating pressures, namely the inlet and two outlets of the cyclone. Although cyclones can work effectively in a controlled situation, it is found in practice during oil field operations, that they often work relatively poorly because of carelessness of operators. Further, the total system, which includes some of the operating parameters of the well, is not a completely stable system and unattended operation over a long period of time can result in changes that adversely affect the operating characteristics of the cyclone. When theh cyclone is not operating properly, relatively large particles can remain in the supposedly clean liquid from the cyclone. Such particles in the power liquid adversely affect the lifetime of pumps.

It is also desirable to provide a pressurized feed to the high pressure multiplex pump employed in a power fluid unit for maximum efficiency. Pressure feed to the high pressure pump may be maintained by keeping the entire separation system and production fluid portion of the well at elevated pressure as described in U.S. Pat. No. 3,709,292. It may also be provided by a circulating pump as described in U.S. Pat. No. 3,802,501.

Thus, it is desirable to provide a single well power fluid system for providing clean power liquid for a downhole pump wherein very small size particulate matter is removed from the power liquid and it is applied to a high pressure pump at appreciable pressure. Such a system should operate with minimal changes in operating characteristics over substantial periods of time without attendance. It is desirable that such a system operate without any appreciable need for sensitive adjustments so that it can be used in oil fields without requiring special operator skills.

BRIEF SUMMARY OF THE INVENTION

There is, therefore, provided in practice of this invention according to a presently preferred embodiment, a power fluid pumping and cleaning system for hydraulic pumping of an oil well having a phase separation vessel for gravity separation of oil, water and gas, including means for receiving exhausted power liquid and produced well fluid from a well head and for delivering produced fluids to a production flow line. The system also includes a high pressure pump for delivering high pressure power liquid withdrawn from the phase separation vessel to a well head. The power liquid is cleaned and pressurized as a feed for the high pressure pump by a combined pitot pump and centrifugal cleaner with a rotatable cleaning chamber that discharges dirty liquid at its periphery. A fixed pitot tube in the rotatable chamber receives pressurized clean power liquid for delivery to the high pressure pump.

DRAWINGS

These and other features and advantages of the present invention will be appreciated as the same becomes better understood by reference to the following detailed description of a presently preferred embodiment when considered in connection with the accompanying drawings wherein.

DESCRIPTION

Figure 1:
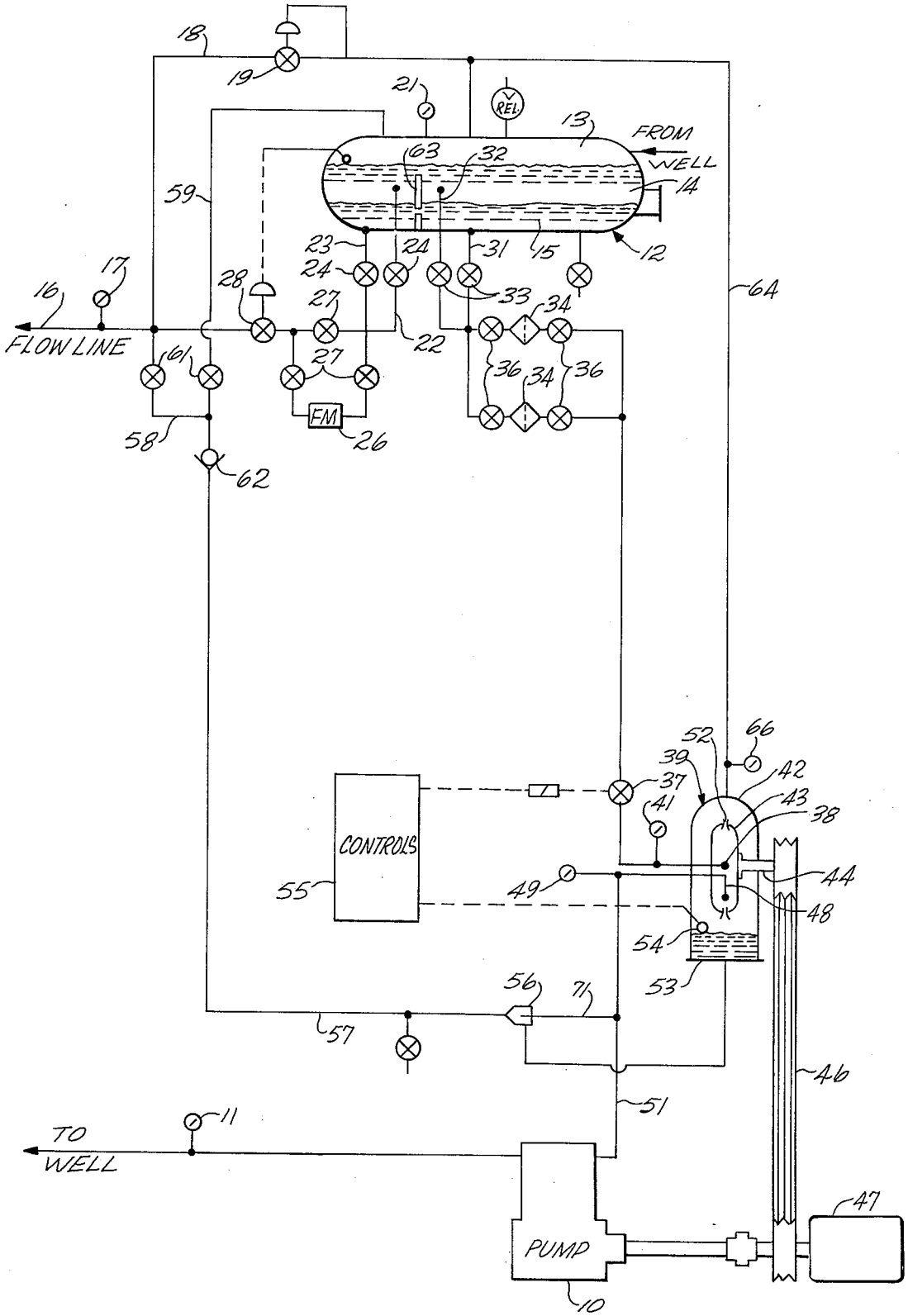
FIG. 1 is a schemtic diagram of an embodiment of cleaning and pumping system embodying principles of this invention.

FIG. 1 illustrates in a schematic flow diagram a single well power fluid pumping and cleaning unit constructed according to principles of this invention. As illustrated in this embodiment, a multiplex pump 10 such as a triplex piston pump supplies high pressure power fluid to an oil well. Typically the pressure from the pump outlet as indicated by a gauge 11, is in the order of 3000 to 5000 psig. Fluid produced from the well goes to a phase separation vessel 12, where gravity separates free water and gas from the crude oil. Thus in a typical installation there is a gas phase 13 in the upper portion of the phase separation tank, an oil phase 14 in a middle portion and a layer of water 15 near the bottom.

The well, which is not illustrated, is a conventional installation having a casing and a string of power fluid tubing within the casing. A well head flow control valve is connected to the well head to communicate with both the casing and the tubing. Power liquid from the multiplex pump 10 passes down the tubing to a downhole pump. The downhole pump lifts produced well fluid, which typically contains water, oil and gas, up the casing to the well head. The spent or exhausted power liquid commingles with the produced well fluids in the hole. Typically, a bypass is also provided at the well head so that a portion of the power liquid is diverted from the downhole pump so that its rate of pumping can be controlled. The well head connections, downhole pump, and the like are all conventional and merely provide the environment in which the present invention is used.

Produced fluid from the phase separation tank 12 is discharged through a production flow line 16 to a tank battery or pipeline. Typically, the pressure in the production flow line 16 as indicated by the gauge 17 is about 100 psig. Connections are made so that oil, water, gas, or mixtures thereof can be obtained from the phase separation vessel. Thus, a pipe 18 is connected between the production flow line 16 and the gas phase portion 13 of the phase separation vessel. A pressure regulating valve 19 provides venting to prevent overpressurization of the phase separation vessel. Typically, the pressure in this vessel as indicated by the gauge 21 is about 125 psig, or less. Preferably the pressure is greater than about 100 psig to maintain flow through the production flow line without auxiliary pumping.

A flow line 22 is provided to the oil phase portion 14 of the phase separation vessel. Similarly, a pipe 23 connects to the lower portion of the vessel where the water phase 15 is present. Valves 24 in these lines permit the operator to select the level of removal of liquid from the vessel to maintain principally a water phase or oil phase in the vessel. The liquid flow lines 22 and 23 are connected to a flow meter 26 to permit measurement of the flow of liquids produced from the well. Valves 27 are also provided for bypassing the flow meter if desired. A float controlled valve 28 is also provided between the liquid connections 22 and 23 and the production flow line 16 so that an approximately constant liquid level can be maintained in the phase separation vessel.

A power liquid connection 31 is provided in the bottom portion of the phase separation vessel where the water phase 15 is present. Similarly a power liquid connection 32 is made in a mid-portion of the vessel where the oil phase 14 is present. Valves 33 in these two power liquid connections permit the operator to select whether the power liquid is to be water or crude oil. There are certain advantages and preferences for each liquid in particular oil field situations and it is desirable to provide such flexibility of choice. Operation of the pumping and cleaning portion of the system is substantially independent of the particular power liquid selected by the operator although when water is used an auxiliary chemical pump (not shown) may be employed for chemical additives to the water for retarding corrosion and providing lubrication for the pumps. Also, if crude oil is the power liquid, the cleaner tends to remove water as well as solids from the oil, thereby minimizing corrosion problems.

The power liquid passes through either of a pair of strainers or filters 34 which remove relatively coarse particulate material that may be present in the liquid. Bypass valves 36 are provided so that each strainer can be isolated from the system and cleaned without shutting down. The power liquid then flows through a solenoid valve 37 to the inlet 38 of a combined pitot pump and centrifugal cleaner 39. The solenoid valve 37 is normally closed when the system is shut down to prevent liquid from flowing from the phase separation vessel. The pressure at the inlet to the combined pump and cleaner, as indicated by the gauge 41, is about the same as the pressure in the phase separation vessel with a head difference of about three feet or more so that liquid will flow from the tank to the pump inlet. Suction produced by the combined pitot pump and centrifugal cleaner 39 may decrease this pressure (i.e. increase the pressure difference) when the equipment is running.

The combined pitot pump and centrifugal cleaner 39 may take a variety of forms in specific embodiments. A typical combined pitot pump and centrifugal cleaner suitable for use in practice of this invention is described in U.S. Pat. No. 3,817,446 by J. W. Erickson, et al.

In each embodiment the combined pitot pump and centrifugal cleaner has a stationary housing 42 in which is mounted a rotatable cleaning chamber 43, as indicated schematically in FIG. 1. The cleaning chamber is rotated by a shaft 44 connected by V-belts 46 to an electric motor 47 which is also the prime mover for the multiplex pump 10. In a typical embodiment for a well producing up to 3000 barrels per day of well fluids, a 150 horsepower motor 47 is suitable. Typically the multiplex pump 10 requires about 100 horsepower and the combined pitot pump and centrifugal cleaner requires about 40 horsepower.

A fixed pitot tube 48 is mounted in the rotatable cleaning chamber 43 of the combined pump and cleaner. As the chamber rotates, the liquid in it reaches high rotational velocities and the velocity head so produced is transformed to a pressure head as liquid enters the fixed pitot tube 48. Output pressures from the pitot tube 48, as indicated by the gauge 49, is typically about 50 psi greater than the pressure in the phase separation vessel. This liquid is passed by a line 51 to the suction inlet of the multiplex pump 10. Thus, a pressurized input is provided for the high pressure multiplex pump 10, enhancing its ability to provide high pressure power liquid to the well head.

One or more discharge passages 52 are provided in the periphery of the rotatable cleaning chamber 43. As this chamber rotates particulate material, such as sand and other particles from the well, that may be present in the power liquid are forced to the periphery by the centrifugal acceleration. Thus, a relatively "dirty" liquid containing any fine particles that pass the strainers 34 is near the periphery of the rotating chamber and passes through the discharge passages into the surrounding housing 42. The strainers 34 remove any particles large enough to plug the peripheral passages. The peripheral discharge passages 52 are relatively small so that in the order of about 10% of the total liquid entering the combined pitot pump and centrifugal cleaner is discharged through the peripheral passages, carrying any particulate matter with it. The pitot tube 48 is spaced inwardly from the periphery of the rotating chamber so that clean power liquid free of potentially damaging particles is collected.

The dirty liquid discharged from the peripheral passages 52 collects in a basin 53 below the rotating chamber. A fluid 54 in the basin senses liquid level and is connected to a control panel 55 for the system. The liquid level in the basin provides a measure of the flow rate of the dirty liquid as mentioned hereafter. If this flow rate is excessive or insufficient, the system is shut down by turning off the motor 47. If the system is shut down the solenoid valve 37 is also closed by the control system. The control system also includes starting circuitry for the motor 47.

Dirty liquid is withdrawn from the basin 53 by a conventional jet pump 56, the suction inlet of which is in fluid communication with the basin. The jet inlet of the jet pump is connected to the pipe 51 from the pitot tube 48 of the combined pitot pump and centrifugal cleaner to the suction inlet of the multiplex pump. The resultant liquid jet draws dirty liquid from the basin and discharges both the jet liquid and the fluid from the suction inlet into a line 57 which is connected to the production flow line 16 by a pipe 58. Another pipe 59 permits discharge of dirty liquid into the phase separation vessel 12 in cases where maintenance of a sufficient volume of power liquid from produced fluids is marginal or where it is desirable to avoid bypassing the flow meter 26. Valves 61 in the discharge lines 58 and 59 permit the operator to select the point of discharge of the dirty liquid. A check valve 62 prevents reverse flow of production fluid into the housing of the combined pump and cleaner.

It is generally preferred to discharge the dirty liquid directly into the production flow line 16 so that particles removed by the cleaner have no opportunity for recirculation through the phase separation vessel. A baffle 63 is provided in the phase separation vessel so that in cases where dirty liquid is returned to it, it does not freely mix with the balance of the liquid in the vessel and particles are generally discharged therefrom through the production flow line connections 22 or 23. If desired, production fluid from the well may also enter the phase separation vessel behind a baffle to minimize particle mixing with power liquid.

A jet pump is particularly preferred for scavenging fluid from the basin since it is essentially a volumetric pump that can accommodate either liquid or gas in the suction inlet without damage to the pump or reduction in pumping efficiency. Under some conditions gas may be present in the fluid flowing from the housing of the combined pump and cleaner, and the gas is discharged by the jet pump along with dirty liquid.

In the embodiment illustrated in FIG. 1 the housing 42 is made strong enough to have appreciable pressure resistance and is connected to the gas phase portion of the phase separation vessel 12 by a line 64. Thus, the pressure in the housing, as indicated by the gauge 66, is up to about 125 psig. Pressure on the suction inlet of the jet pump is also about the same as the pressure in the phase separation vessel. The increased pressure in the line 51 from the pitot tube is therefore sufficient for pumping dirty liquid directly into the production flow line 16 or phase separation tank 12 by means of a jet pump.

Figure 2:
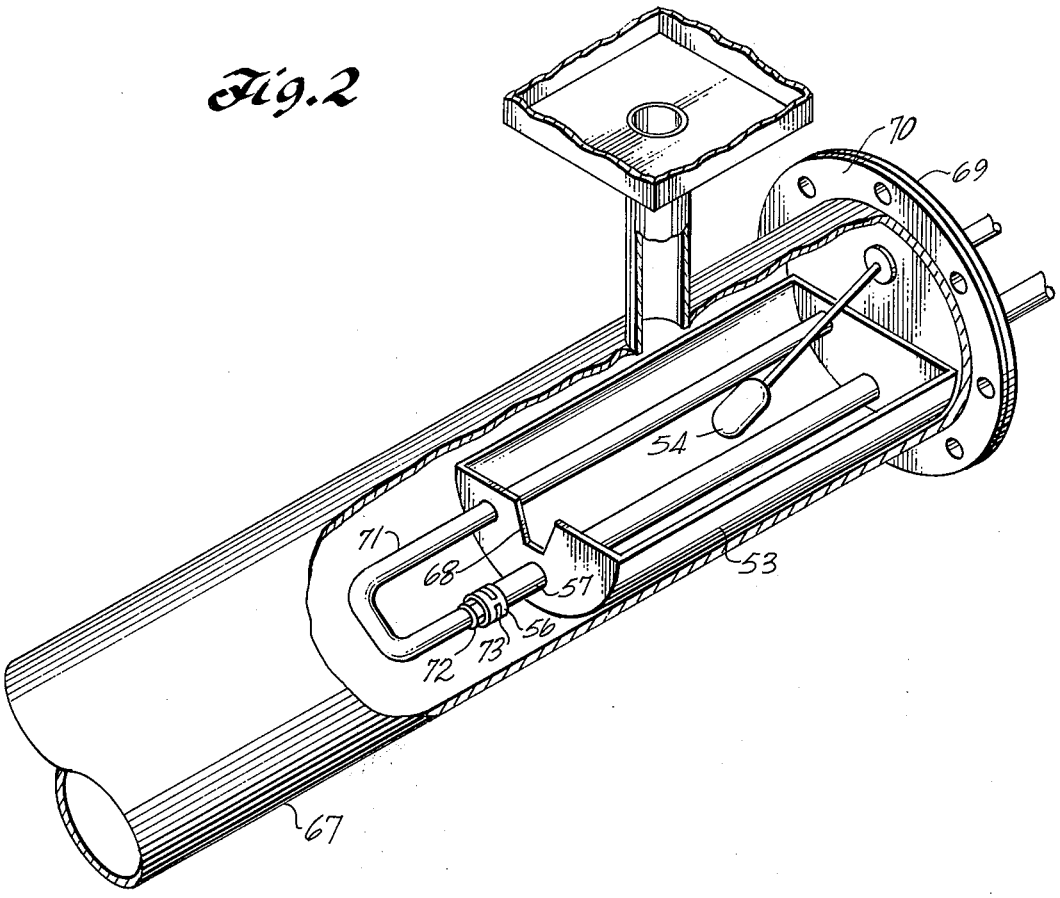
FIG. 2 illustrates in partial cutaway a dirty liquid flow sensor for a cleaning and pumping system.

FIG. 2 illustrates in cutaway view a flow rate sensing system for the combined pitot pump and centrifugal cleaner. As illustrated in this arrangement the basin 53 in which dirty liquid from the combined pump and cleaner 39 accumulates is located in a pipe 67 beneath the combined pump and cleaner. Dirty liquid therefore flows by gravity from its housing into the basin. The basin is a generally semi-cylindircal vessel open on its top with a V-shaped weir 68 at the end. The basin is preferably integral with a plate 69 which can readily be bolted to a flange 70 on the end of the pipe for removal or maintenance. A tube 71 passes through the plate 69 and is connected to the jet inlet 72 of the jet pump 56. The jet pump discharge line 57 also passes through the end plate 69. The suction inlet 73 of the jet pump is outside the basin 53.

Dirty liquid from the combined pitot pump and centrifugal cleaner 39 flows from its housing into the basin 53 and overflows through the V-shaped weir 68. The overflow from the weir is drawn from the pipe 67 by the jet pump 56 and discharged as hereinabove described. Typically, the volume of dirty liquid is in the range of from about 4 to 9 gallons per minute. During normal flow in this range the float 54 maintains a position on the liquid at a desired depth in the basin. If the flow should be insufficient, liquid level in the basin drops, thereby lowering the level of the float and causing a low level shut down of the system. Flow can become insufficient if the strainers 34 or discharge passages 52 become plugged. It is desirable to shut down the system in this situation to avoid particulate damage to the pumps.

On the other hand, if the liquid level becomes too high in the basin, due to too high a flow rate from the housing or limited discharge of dirty liquid by the jet pump (for example, if the operator leaves both valves 61 closed), a high level shut down is reached by the float 54, and the system is turned off for its own protection. If the liquid level rises too much, there may be excess liquid around the rotating chambers of the pitot pump and centrifugal cleaner, causing highly inefficient if not damaging operation.

Figure 3:
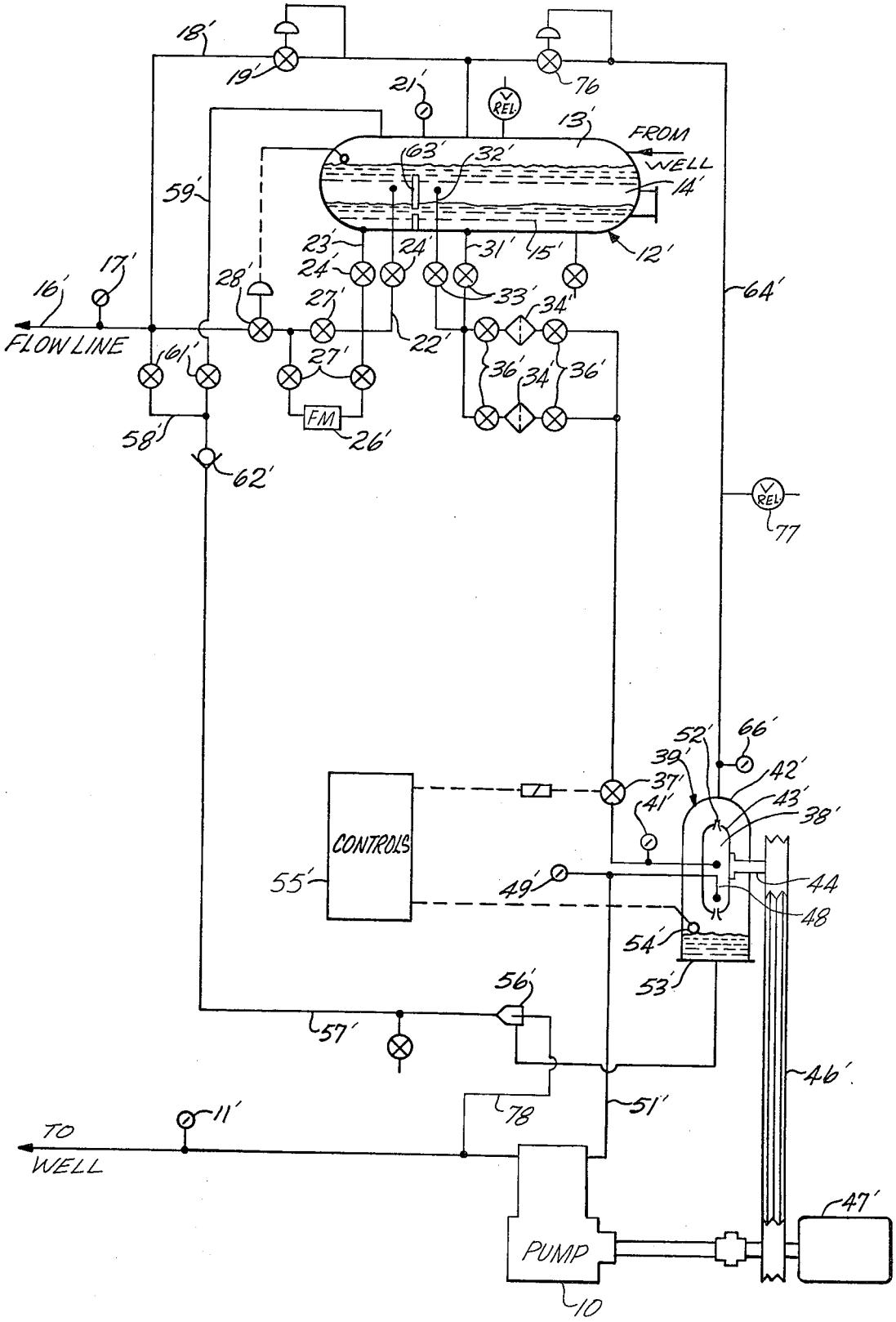
FIG. 3 is a schematic diagram of another embodiment of this invention wherein the combined cleaner and pump operates under relatively lower pressure.

FIG. 3 illustrates in schematic flow diagram a single well power fluid pumping and cleaning system quite similar to that illustrated in FIG. 1, but for operation of the combined pitot pump and centrifugal cleaner at a lower pressure. Such a system can be advantageous where it is undesirable to maintain an elevated pressure in the housing for the combined pump and cleaner. Because of the great similarity between the systems illustrated in FIGS. 1 and 3 the same reference numerals are employed in FIG. 3 for similar parts except that each is designated by a prime.

As illustrated in the embodiment of FIG. 3 a pressure control valve 76 is provided in the connection between the housing 42' of the combined pitot pump and centrifugal cleaner 39', and the phase separation vessel 12'. The pressure regulating valve 76 maintains a pressure in the housing, as indicated by the gauge 66', of about 5 to 15 psig. A pressure relief valve 77 is also provided in the line 64' between the separation vessel and housing to release at about 20 psig to prevent damage to the housing. Thus, in this embodiment the pressure on the dirty liquid is only about 5 to 15 psig and the pressure in the line 51' from the pitot tube 48' may be insufficient for operating the jet pump 56' for discharge of dirty liquid into the production flow line 16'. A connection 78 is therefore provided from the outlet of the high pressure multiplex piston pump 10' to the jet inlet of the jet pump 56'. This high pressure jet of liquid raises the discharge pressure from the jet pump sufficiently to discharge into the production flow line or phase separation tank as desired. This minor modification makes operation of the combined pitot pump and centrifugal cleaner at low pressure quite feasible so that there is power liquid cleaning and a pressurized input to the multiplex high pressure pump.

Although limited embodiments of power fluid pumping and cleaning system for an oil well have been described and illustrated herein, many modifications and variations will be apparent to one skilled in the art. Thus, for example, instead of discharging the jet pump effluent directly into the production flow line or phase separation vessel it can be added to the flow line upstream from the flow meter to assure that all portions of production fluid are metered. Centrifugal or other high pressure pumps may be used instead of the multiplex pump described herein. Many other modifications and variations will be apparent to one skilled in the art and it is therefore to be understood that within the scope of the appended claims the invention may be practiced otherwise than as specifically described.

What is claimed is:

1. A power fluid system for hydraulic pumping of an oil well comprising:

a phase separation vessel for gravity separation of oil, water, and gas including means for receiving exhausted power liquid and produced well fluid from a well head and means for delivering fluid to a production flow line;

a high pressure pump for delivering high pressure power liquid to a well head;

means for withdrawing power liquid from the phase separation vessel;

a combined pitot pump and centrifugal cleaner having a rotatable cleaning chamber, a chamber inlet connected to the means for withdrawing power liquid from the phase separation vessel, a stationary pitot tube in the chamber spaced from its periphery for receiving clean liquid, a pressure outlet connected between the pitot tube of the pitot pump and the inlet of the high pressure pump for delivering pressurized clean power liquid, and dirty liquid discharge means at the periphery of the cleaning chamber for discharging dirty liquid;

a jet pump having a jet inlet, a suction inlet in fluid communication with the dirty liquid discharge means for withdrawing dirty liquid, and an outlet means for connecting the output of the jet pump to a production flow line for discharging dirty liquid; and means for delivering pressurized power liquid to the jet inlet of the jet pump.

2. A power fluid system as defined in claim 1 wherein the means for delivering pressurized power liquid comprises a liquid connection between the outlet of the high pressure pump and the jet inlet of the jet pump.

3. A power fluid system as defined in claim 2 further comprising means for maintaining pressure in the combined pitot pump and centrifugal cleaner outside the cleaning chamber at less than about 20 psig.

4. A power fluid system as defined in claim 1 wherein the means for delivering pressurized power liquid comprises a liquid connection between the pitot tube outlet of the combined pitot pump and centrifugal cleaner and the jet inlet of the jet pump.

5. A power fluid system as defined in claim 4 wherein the combined pitot pump and centrifugal cleaner includes a pressure resistant housing and further comprising a gas connection between the top of the phase separation vessel and said housing for maintaining substantially equal pressures therein.

6. A power fluid system as defined in claim 1 further comprising a flow sensor connected to the dirty liquid discharge means, and means for interrupting pumping upon sensing either excessive or insufficient flow.

7. A power fluid system as defined in claim 6 wherein the flow sensor comprises:

a basin adjacent the dirty liquid discharge means for receiving dirty liquid;

an overflow weir in the basin for discharging dirty liquid therefrom at a rate that is a function of liquid level in the basin; and a liquid level sensor in the basin; and wherein the jet pump suction inlet is adjacent the overflow weir for withdrawing dirty liquid overflow.

8. In a power fluid pumping and cleaning system for hydraulic pumping of an oil well including a high pressure pump connectable to a well head for delivering high pressure power liquid thereto; and a phase separation vessel for receiving exhausted power liquid and produced well fluid, separating water, oil and gas and delivering fluids to a production flow line; an improved cleaning and pumping system for withdrawing power liquid from the phase separation vessel removing particles from the power liquid and delivering cleaned power liquid under pressure to the suction inlet of the high pressure pump, wherein the improvement comprises:

a combined centrifugal cleaner and pitot pump having a stationary housing, a rotatable cleaning and pumping chamber in the housing, a liquid inlet to the chamber, a stationary pitot tube outlet in the chamber for withdrawing pressurized clean power liquid, and means for discharging dirty liquid from the periphery of the chamber into the housing;

means for connecting the liquid inlet to the phase separation vessel;

means for delivering power fluid from the pitot tube outlet to the suction inlet of the high pressure pump; and means for pumping dirty liquid from the housing to a production flow line.

9. In a power fluid system as defined in claim 8 the further improvement comprising a flow sensor connected to the means for discharging dirty liquid, and means for interrupting pumping upon sensing either excessive or insufficient flow of liquid.

10. In a power fluid pumping and cleaning system for hydraulic pumping of an oil well including a high pressure pump connectable to a well head for delivering high pressure power liquid thereto; and a phase separation vessel for receiving exhausted power liquid and produced well fluid, separating water, oil and gas and delivering fluids to a production flow line; an improved cleaning and pumping system for withdrawing power liquid from the phase separation vessel, removing particles from the power liquid and delivering cleaned power liquid under pressure to the suction inlet of the high pressure pump, wherein the improvement comprises:

a combined centrifugal cleaner and pitot pump having a stationary housing, a rotatable cleaning and pumping chamber in the housing, a liquid inlet to the chamber, a stationary pitot tube outlet in the chamber for withdrawing pressurized clean power liquid, and means for discharging dirty liquid from the periphery of the chamber into the housing;

means for connecting the liquid inlet to the phase separation vessel;

means for delivering power fluid from the pitot tube outlet to the suction inlet of the high pressure pump;

means for pumping dirty liquid from the housing to a production flow line comprising a jet pump having a jet inlet, a suction inlet in fluid communication with the means for discharging dirty liquid, and an outlet connectable to a production flow line; and means for delivering pressurized fluid to the jet inlet.

11. A power fluid system as defined in claim 10 wherein the means for delivering pressurized power liquid comprises a liquid connection between the outlet of the high pressure pump and the jet inlet of the jet pump.

12. A power fluid system as defined in claim 10 wherein the means for delivering pressurized power liquid comprises a liquid connection between the pitot tube outlet of the combined centrifugal cleaner and pitot pump and the jet inlet of the jet pump.

13. A power fluid system as defined in claim 12 wherein the combined centrifugal cleaner and pitot pump includes a pressure resistant housing and further comprising a gas connection between the top of the phase separation vessel and said housing for maintaining substantially equal pressures therein.

14. In a power fluid system as defined in claim 10 the further improvement comprising a flow sensor connected to the means for discharging dirty liquid and means for interrupting pumping upon sensing either excessive or insufficient flow of liquid.

15. A power fluid system as defined in claim 14 the further improvement wherein the flow sensor comprises:

a basin adjacent the means for discharging dirty liquid;

an overflow weir in the basin for discharging dirty liquid therefrom at a rate that is a function of liquid level in the basin; and a liquid level sensor in the basin; and wherein the jet pump suction inlet is adjacent the overflow weir for withdrawing dirty liquid overflow.

* * * * *